US006164272A

United States Patent [19]

Fouy

[11] Patent Number: 6,164,272

[45] Date of Patent: Dec. 26, 2000

[54] MANUAL TILE CUTTER

[75] Inventor: Jean-Marie Fouy, Raimbauct, France

[73] Assignee: Diamant Boart SA, Brussells, Belgium

[21] Appl. No.: 09/314,748

[22] Filed: May 19, 1999

[30] Foreign Application Priority Data

Jun. 11, 1998 [FR] France ..... 98 07402

[51] Int. Cl.[7] ..... B28D 1/02

[52] U.S. Cl. ..... 125/12; 125/35; 125/23.02; 225/96.5; 83/879; 83/886

[58] Field of Search ..... 125/35, 23.02, 125/12; 225/96.5, 96, 94; 83/879, 880, 886

[56] References Cited

U.S. PATENT DOCUMENTS 5,169,045 12/1992 Liu .
5,303,690 4/1994 Ishii .
5,560,274 10/1996 Turner .
5,615,665 4/1997 Thiriet .

*Primary Examiner*—Timothy V. Eley
*Assistant Examiner*—Willie Berry, Jr.
*Attorney, Agent, or Firm*—Laff, Whitesel & Saret, Ltd.; J. Warren Whitesel

[57] ABSTRACT

A manual appliance for cutting tiles, has a carriage (4) which slides above a base (1) which receives a tile to be cut. The carriage (4) has a cutting wheel (19) and a breaking head (23). The breaking head (23) is able to respond to a control means (34), in order to adopt either an idle retracted position so that the wheel comes into contact with and score the tile placed on the base (1), or, a working position in which only the breaking member comes into contact with the top face of the tile. The carriage has a handle (21) for exerting a bearing force on the wheel (19) when it scores the tile, and a bearing force on only breaking member (23) when it is in its working position.

11 Claims, 5 Drawing Sheets

MANUAL TILE CUTTER

Figure 1:
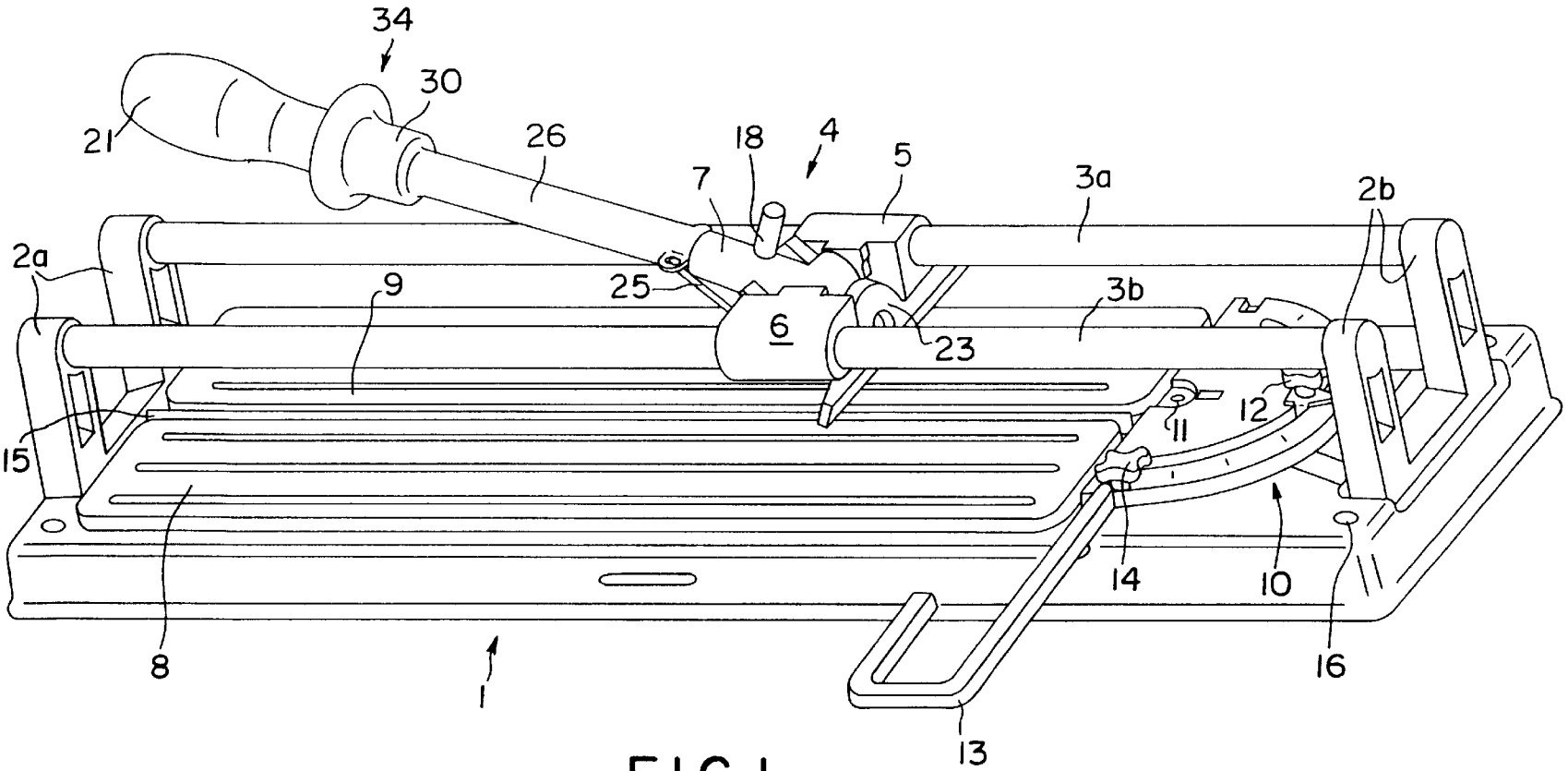

The present invention concerns a manual appliance for cutting tiles, notably ceramic tiles.

Such appliances generally have a fixed part, or base, which makes it possible to position the tile to be cut, and a movable part or carriage, sliding between two extreme positions, on at least one rail connected to the base. This carriage runs above the tile support, and has an articulated manoeuvring rod, a notching wheel for initially marking the tile, a head and its moving mechanism, in order to secondly break the tile by means of lateral supports placed at each side of a longitudinal ridge, situated underneath the path of the wheel.

The patent document FR-A 2 462 244 is known, which shows a tile cutting appliance such as the one which has just been described, and which affords an automatic positioning of the breaking head. The breaking head, in an upper position, follows the notching wheel during its path over the tile, and then comes into contact with the latter when the wheel is housed in a space in front of the tile. This arrangement makes it necessary to break the tile by pressing on a part close to one edge, without distributing the stresses evenly in the tile. The latter can fracture into several assorted pieces.

The European patent document EP-A 387 142 is also known, which requires manual intervention for positioning the breaking head, by means of a smaller lever situated on the carriage. During this operation, it is not possible to manually hold the tile on its support. However, it is absolutely necessary for the tile not to move between the cutting operation and its breaking, otherwise it may break badly and make it unusable.

One aim of the invention is therefore to propose an appliance for cutting tiles which affords rapid and precise cutting of the tile, performing the notching and breaking operation with a single hand, the other hand being used for effectively holding the tile on its support.

To this end, a manual appliance for cutting tiles according to the invention is characterised in that the means of controlling the breaking head are placed close to the free end of the handle.

According to another characteristic of the invention, the breaking head is designed to be able to pivot between its idle position and its working position, the appliance having a member for connecting the control means to the breaking head in order to control the pivoting of the breaking head. The connecting member is for example a link.

According to another characteristic of the invention, the control means consist a sleeve slidably mounted on the manoeuvring lever to which the connecting member is connected, the sleeve being provided, for its manoeuvring, with a collar. Advantageously, the collar extends the sleeve in the direction of a handle at the free end of the manoeuvring lever.

According to another characteristic of the invention, it has a return means which tends to hold the breaking head in its idle position. The return means is for example a spring designed so as to act on the sleeve.

According to a variant embodiment of the invention, the said control means consists of a lever which is mounted so as to pivot on the manoeuvring lever and to which the said connecting member is connected.

According to another characteristic of the invention, the breaking head has an angular stop in contact, in the working position of the breaking head, with a protuberance on the bearing.

Figure 2:
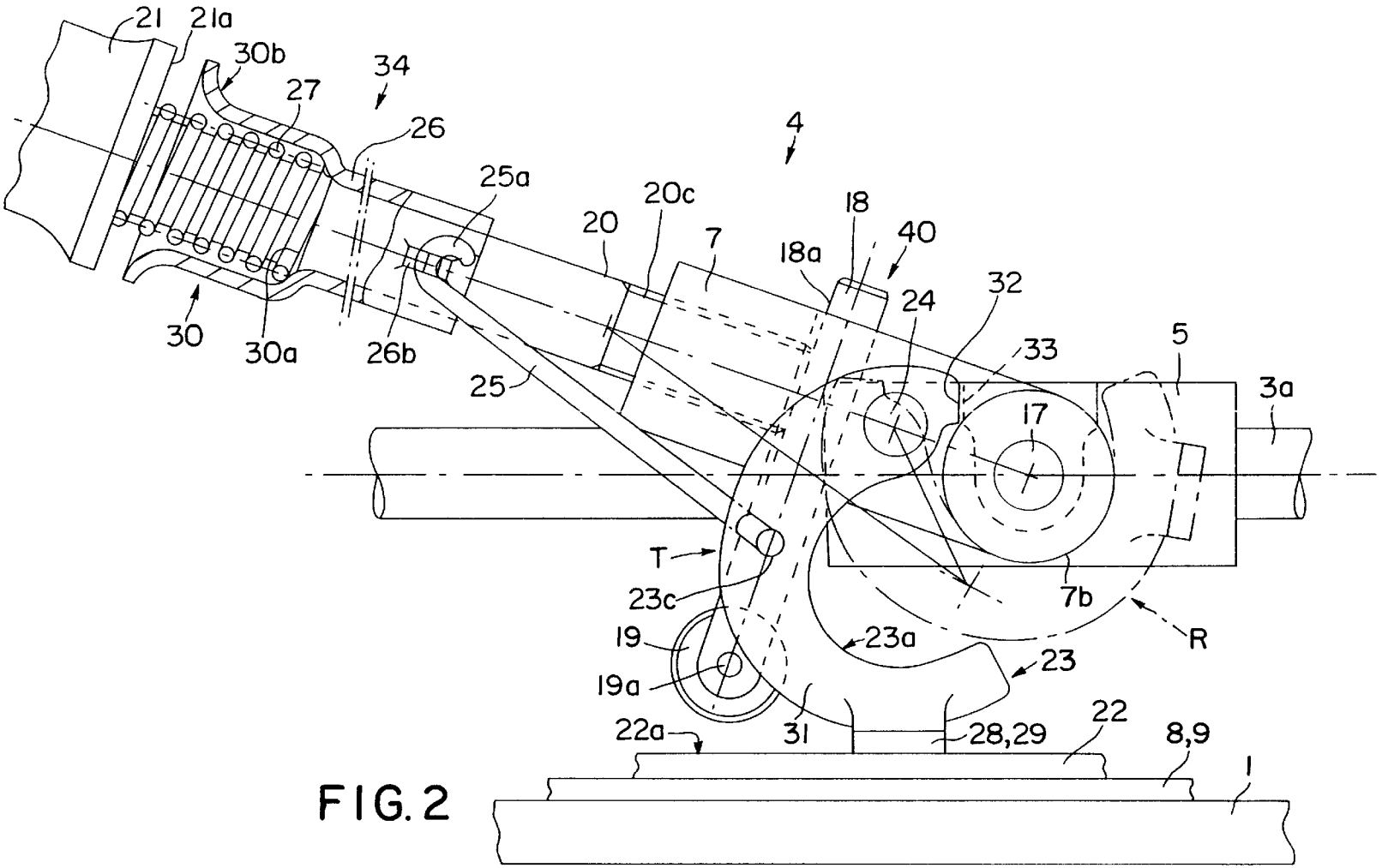
Figure 3:
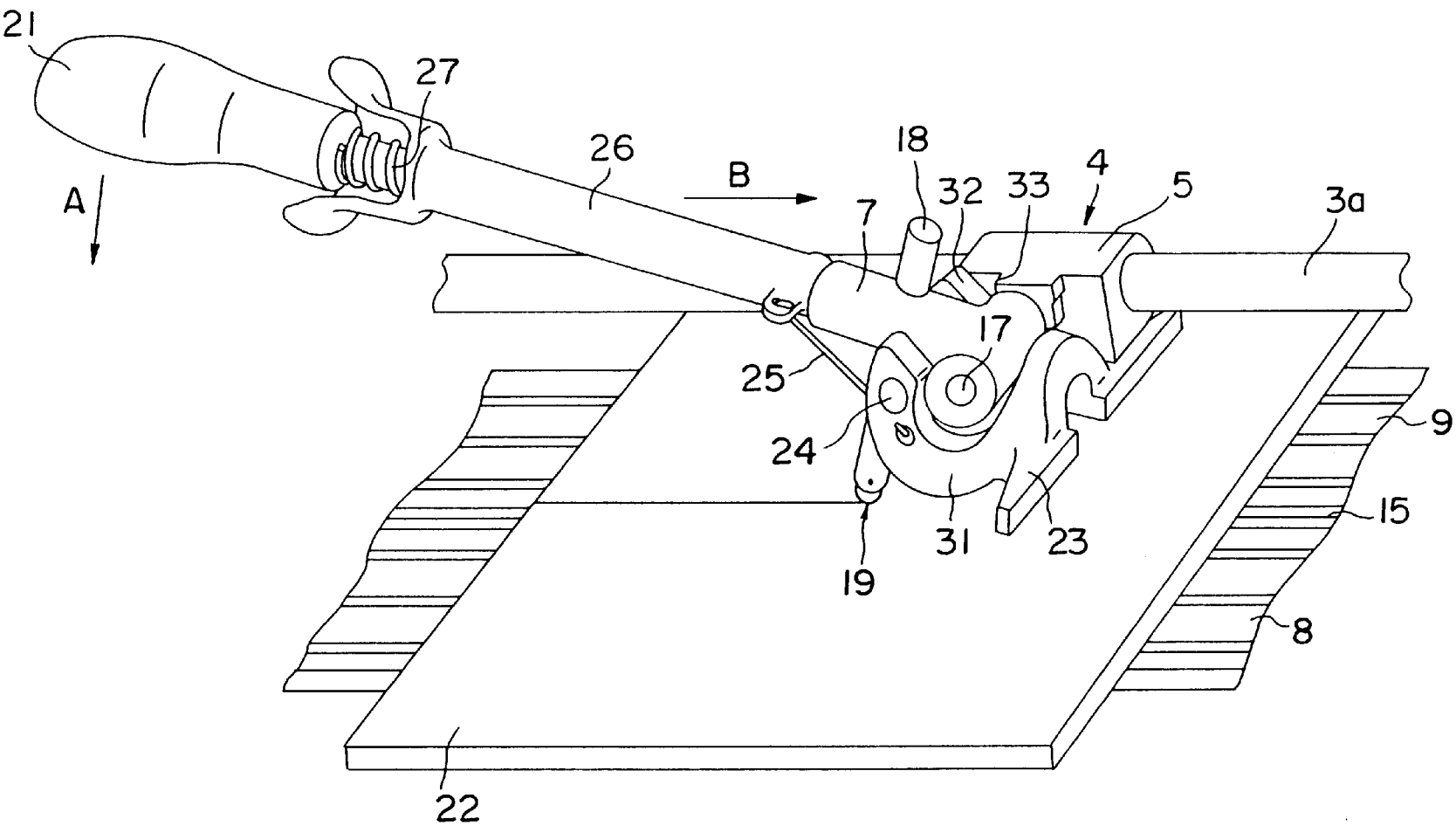
Figure 4:
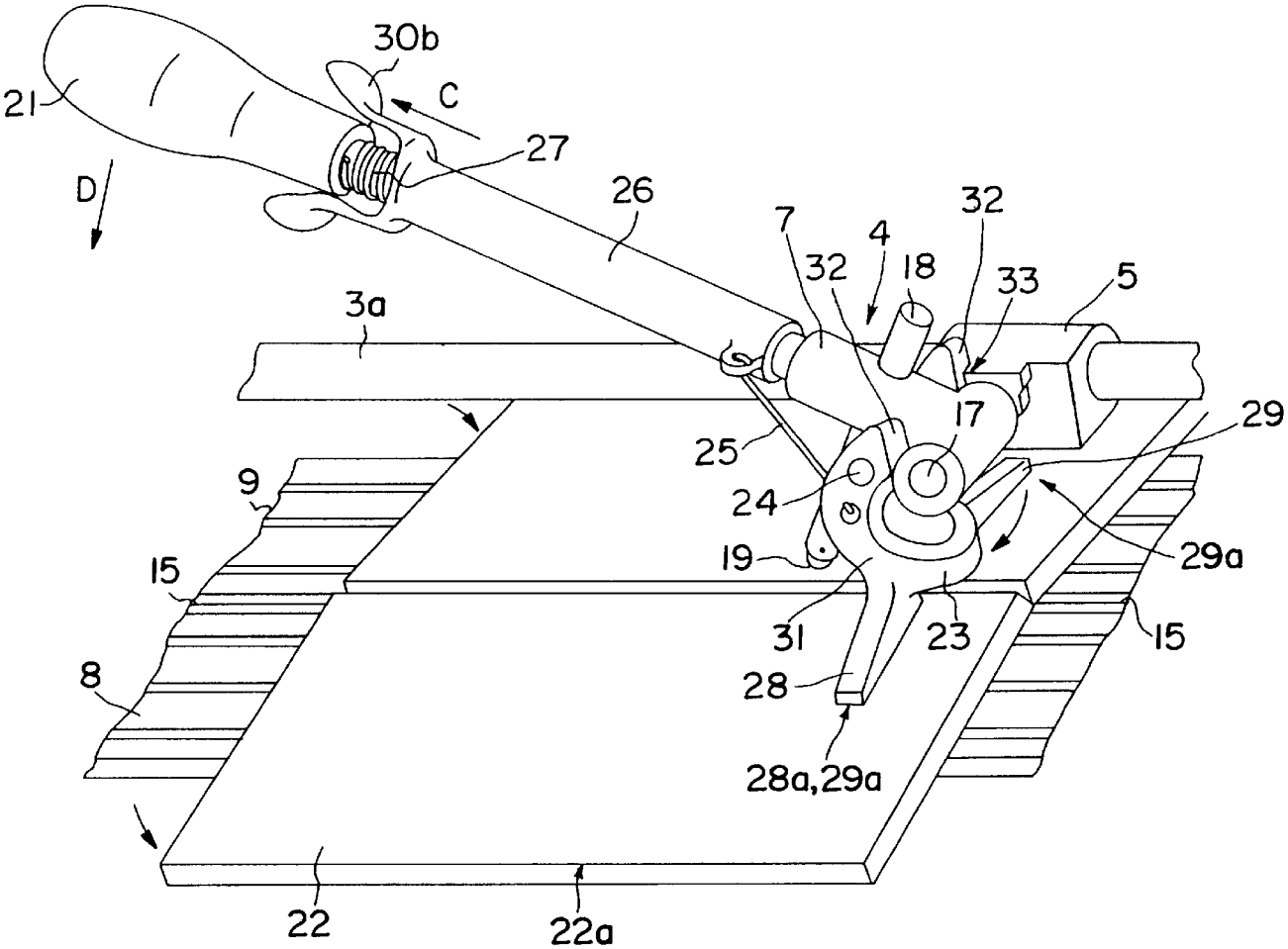
Figure 5:
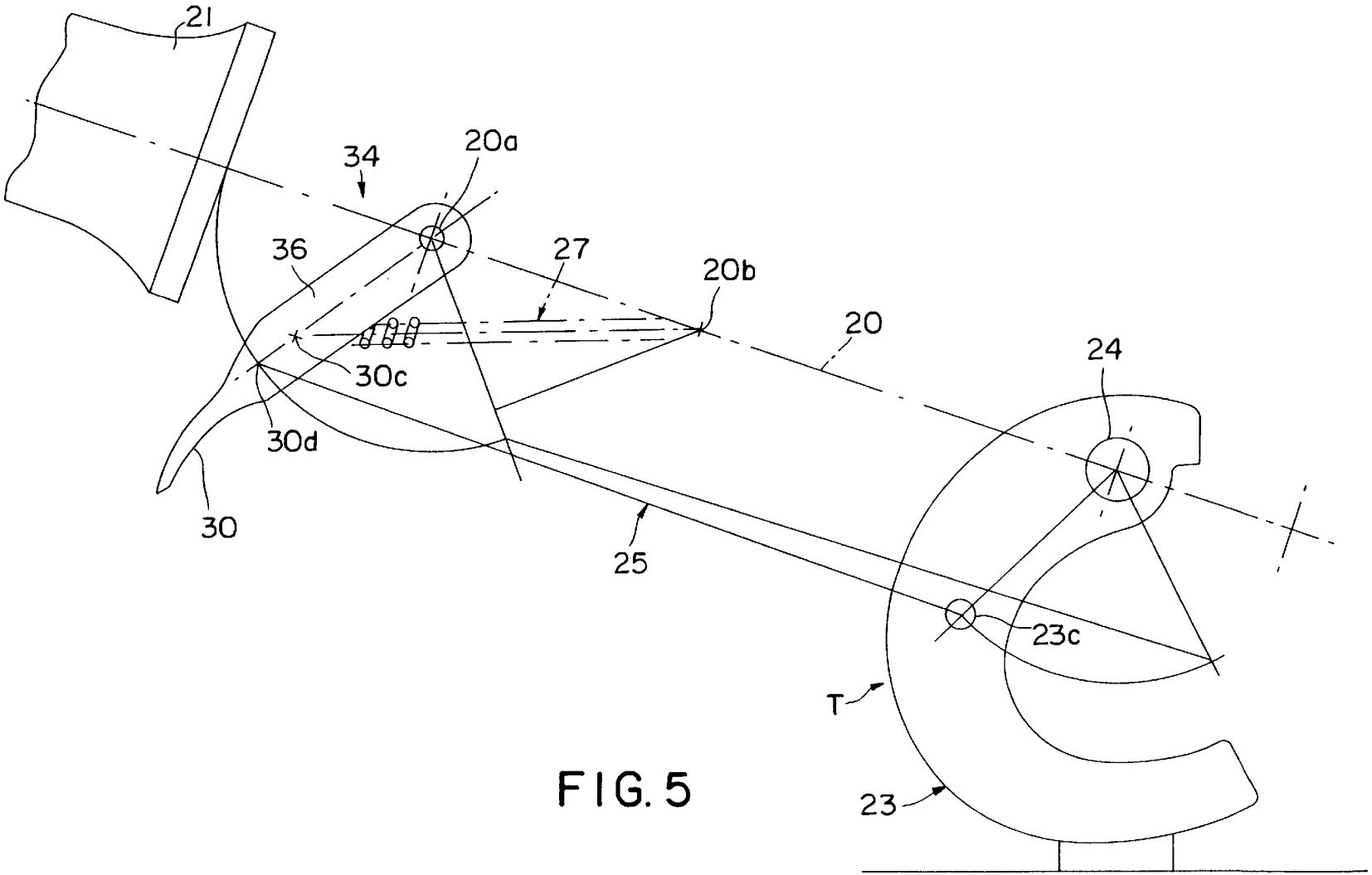

The characteristics of the invention mentioned above, and others, will emerge more clearly from a reading of the following description of an example embodiment, the said description being given in relation to the accompanying drawings, amongst which:

FIG. 1 shows a perspective view of a manual tile cutting appliance according to the invention, FIG. 2 is a partial front view of a manual tile cutting appliance according to the invention, on which one of the guide runners 3*b* is not shown in order not to overload the figure, FIG. 3 is a partial perspective view which illustrates the functioning of a manual tile cutting appliance according to the invention, during the tile notching phase, FIG. 4 shows a partial perspective view which illustrates the functioning of a manual tile cutting appliance according to the invention, during the tile breaking phase, and FIG. 5 depicts a variant embodiment of the control means of a manual tile cutting appliance, according to an invention.

The manual tile cutting appliance depicted in FIG. 1 consists essentially of a base 1 and a carriage 4.

To the base 1, of rectangular appearance, there are attached two supports 8 and 9, for example made of flexible material, intended to receive the tile to be cut 22. The base 1 has fixed bearings 2*a* and 2*b* respectively placed at the ends of the said base and which are designed to hold, by their respective ends, runners 3*a* and 3*b* parallel to each other and to the base 3 in the direction of its length.

FIG. 1, the two runners 3*a* and 3*b* are circular in cross section, but it will be understood that their number and the shape of their cross section can be different without modifying the scope of the present invention. The same applies with regard to the number of fixed bearings 2*a* and 2*b*.

The base 1 also has a ridge 15 supporting the tile, placed in a longitudinal mid-plane on the base 1, and projecting between and above the surface consisting of the supports 8 and 9.

In the example embodiment depicted, the base 1 also has an axial stop 10 of semi-cylindrical shape, which can be adjusted about the axis 11 in order to allow, in cooperation with a movable rule 13, the cutting of tiles at a particular angle. Clamping nuts 12 and 14 enable the initial adjustments of this axial stop 10 and rule 13 to be fixed in order to ensure identical repetitive cuts.

As for the carriage 4, this is provided with movable bearings 5 and 6 respectively mounted so as to slide on the runners 3*a* and 3*b* on the base 1 so as to make it movable in translation on said runners 3*a* and 3*b* between the two bearings 2*a* and 2*b*.

FIG. 2 shows in detail the construction of the movable carriage 4. It can be seen in this FIG. 2 that the movable bearings 5 and 6 (only the bearing 5 is shown) are connected together by a transverse shaft 17 on which there is mounted an articulation 7 so as to be able to pivot about this shaft 17.

A manoeuvring lever 20 having, at one of its free ends, a manoeuvring handle 21 is fixed to the articulation 7 so that it is possible to control the pivoting of the articulation 7 about the shaft 17. In FIG. 2, the manoeuvring lever 20 is perpendicular to the shaft 17, but may however not be mounted so as to converge.

A wheel 19 is mounted, by means of a support 18, on the articulation 7 opposite the support faces 8 and 9 of the base 1 and so as to be able to come into contact with the top face 22*a* of the tile to be cut 22, placed on the said support faces 8 and 9 of the base 1.

In the example embodiment depicted, the wheel support 40 consists of a rod 18 having, at one of its ends, the wheel 19 free to rotate about a transverse shaft 19*a*.

The rod 18 is housed and locked, by any suitable means. In FIG. 2 the other free threaded end 20*c* of the manoeuvring lever 20, screwed into an articulation thread 7, bears on a plane surface 18*a* of the rod 18 and locks it.

It can be seen that, under the control of the handle 21, the wheel 19 can adopt either an upper position which it is retracted from the tile to be cut 22, or a lower position in which it is in contact with the top face 22*a* of the tile 22.

A breaking head 23 is attached to the articulation 7. This head consists of two lateral C-shaped checks 31, joined at their lower parts by an underframe broadened at its base forming lateral supports 28 and 29.

The top part of each cheek 31 has passing through it a transverse shaft 24 which is mounted on the articulation 7, so that the breaking head 23 can pivot about this shaft 24. As will be understood subsequently, the transverse shaft 24 is offset with respect to the transverse shaft 17. The internal part of the C of each cheek 31 has an appropriately circular shape 23*a* designed to come into contact with a surface 7*b*, also of circular shape, of the articulation 7, in a so-called idle position R in fine dot and dash lines in FIG. 2.

On the upper part of each cheek 31 and offset upwards compared with the shaft 24, an angular stop 32 is provided, designed to come into contact with a substantially vertical protuberance 33 on the movable bearing 5, and this in a so-called working position T, in bold lines in FIG. 2.

This breaking head 23 can thus adopt all the positions included between the two noteworthy positions mentioned previously, that is to say the idle position R, where it is retracted, or the working position T, where it can come into contact with the tile 22.

The breaking head 23 also has a fixing 23*c* on one of its cheeks 31, offset downwards with respect to the shaft 24. This fixing 23*c* is connected to a link 25 described below.

Control means 34 are mounted so as to slide on the manoeuvring lever 20 between the handle 21 and the articulation 7. They consist of a cylindrical hollow sleeve 26 which has, close to its bottom end, a fixing 26*b*, and a hollow control member 30 extending the sleeve 26, the free end of which, disposed close to the handle 21, is in the form of a collar 30*b*.

A return means 27, in this case a spring in FIG. 2, bears on the one hand on a shoulder 21*a* on the handle 21, and on the other hand on the internal wall 30*a* of the control member 30.

The connecting link 25 has a hook 25*a* at each of its ends. This connecting link 25 connects the sliding sleeve 26 by a fixing 26*b*, and the breaking head 23 by the fixing 23*c*.

The manual tile cutting appliance functions in two phases: the first, through notching by means of the wheel 19, marks the top face 22*a* of the tile 22 placed on the flexible supports 8 and 9 and positioned suitably, for example on the axial stop 10 and rule 13. The second phase breaks the tile into two parts, by means of the breaking head 23.

FIG. 3 shows the appliance used during the phase of notching the tile to be cut 22. During this phase, the operator presses radially on the handle 21 (arrow A), so that the wheel 19 comes into contact with the top face 22*a* of the tile to be cut 22.

He then moves the carriage 4 in a reciprocating movement (arrow B), so that the wheel 9 notches the top face 22*a* of the tile 22. The breaking head 23 is in its idle position R, under the action of the spring 27, which exerts a bearing force on the control means 34 sliding on the manoeuvring lever 20. This force is transmitted through the link 25, which pushes the breaking head 23 and holds it in abutment on the surface 7*b* of the articulation 7 through its internal wall 23*a*.

During the second phase (see FIG. 4), the operator places in the working position the breaking head 23 responsible for accurately breaking the tile 22 about the axis consisting of the longitudinal ridge 15. To do this, the operator raises the manoeuvring handle 21 by a few degrees around the shaft 17, so as to separate the wheel 19 from the tile 22. He manoeuvres the control member 30 by means of the collar 30*b* situated close to the manoeuvring handle 21, impeding the action of the return means 27 (see arrow C). He thus forces the breaking head 23 to pass from its idle position R to its working position T, during the period of the action on the control member 30 of the control means 34.

In FIG. 4, the spring 27 is compressed by the control member 30. To do this, the control member 30 has slid on the manoeuvring lever 20, and has in its turn driven the link 25 which has moved the breaking head 23 in rotation about the shaft 24 in order to bring it into its working position T.

In this position, the angular stop 32 on the breaking head 23 comes into contact with the protuberance 33 on the bearing 5 and limits the angular movement of the breaking head 23 in a position where the bottom faces 28*a* and 29*a* are substantially parallel to the top part 22*a* of the tile 22. When the operator then presses vertically on the handle 21 (arrow D), he transmits this force through the breaking head 23 to the lateral sides of the top face 22*a* of the tile 22, by virtue of the lateral supports 28 and 29, until the tile 22 breaks around the ridge 15.

When the operator suspends his action on the control member 30, the spring 27 enables the breaking head 23 to return to its idle position R, after the tile breaking operation, through a kinematics which is the reverse of that of its cocking. The spring 27 drives, in translation in the direction of the articulation 7, the control means 34 which move the link 25. This link 25 rotates the breaking head 23 about the shaft 17, until the angular movement of the said breaking head 23 is limited by the contact of the internal wall 23*a* with the surface 7*b* of the articulation 7; the breaking head 23 is then in its idle position R.

A variant embodiment of the control means 34 of the invention is depicted schematically in FIG. 5, where there appear the breaking head 23 in its working position T, and the control means 34 placed close to the manoeuvring handle 21. The said control means 34 consist of a lever 36 terminating at a free end in a control member 30 in the form of a follower.

The control means 34 are mounted so as to pivot about the articulation 20*a* positioned on the other end of the lever 36, and mounted transversely on the axis of the manoeuvring lever 20.

A link 25 connects the breaking head 23, by its fixing 23*c*, with the control means 34 by means of a fixing 30*d*, placed between the control member 30 and the articulation 20*a* of the control means 34.

A return means 27, in this case a spring 27 in FIG. 5, is attached on the one hand to a fixing 20*b* situated on the axis of the manoeuvring lever 20, and on the other hand with a last fixing 30*c* also placed between the control member 30*b* and the articulation 20*a* of the control means 34.

Manoeuvring the control member 30*b* of the control means 34 transmits a movement to the link 25. This drives the breaking head 23 in rotation about the shaft 24, from an idle position R to a working position T. In the absence of any action on the control member 30, the spring 27 returns the control means 34, which pivot about its axis 20*a*, and push on the link 25 and return the breaking head into the idle position R.

The double manoeuvre for cocking the breaking head 23 and for causing it to descend is effected by just one hand of the operator, who can hold the tile in place under the supports 8 and 9 with his other hand.

What is claimed is:

1. A manual tile cutting appliance comprising a carriage (4) mounted to slide above a base (1); means (8, 9) on said base for receiving a tile which is to be cut; said carriage (4) comprising a cutting wheel (19) and a breaking head (23); control means (34) for moving said breaking head (23) between an idle position and a working position; while in the idle position said breaking head retracts from the upper face of the tile which is to be cut and said cutting wheel comes into contact with the tile placed on the said base (1) and thus scores the tile while the carriage (4) slides; while in the working position only the breaking head comes into contact with the top base of the tile; the carriage (4) having a lever rod (20) for exerting a bearing force on the cutting wheel (19) when it is in contact with the tile in order to score it and exerting a bearing force on said breaking head (23) while it is situated in its working position; said control means (34) being located close to a free end of the rod (20) and being able to move between two extreme positions on the rod (20); means for connecting said control means (34) to the breaking head (23) so that, when said control means (34) moves from one position to another position on the lever rod (20), said breaking head (23) moves between said idle position and said working position.

2. The manual tile cutting appliance according to claim 1, wherein said control means further comprises means including a sleeve (26) slidably mounted on the lever rod (20), and sleeve (26) is connected to the head breaking (23) by a link member (25).

3. The manual tile cutting appliance according to claim 2 wherein said sleeve (26) has a collar **(30*b*) extending from said sleeve (26) and in the direction of a handle (21) at the free end of the lever (20)**.

4. The manual tile cutting appliance according to claim 2 and return means (27) which biases the breaking head (23) into its idle position.

5. The manual tile cutting appliance according to claim 4, wherein said return means is a spring (27) which biases the sleeve (26) into one of said positions.

6. The manual tile cutting appliance according to claim 5 wherein said breaking head (23) has an annular stop (32) in contact with a stationary protuberance (33) while the breaking head (23) is in the working position.

7. The manual tile cutting appliance according to claim 1, further comprising means for enabling said breaking head (23) to pivot about a shaft of the carriage (4); said pivoting being between said idle position and said working position; said control means (34) including a sleeve (26) slidably mounted on the lever rod (20); and sleeve (26) being connected to the breaking head (23) by a connecting link (25) so that, when the sleeve (26) slides on the lever rod (20), said breaking head (23) moves between from the idle position and the working position.

8. The manual tile cutting appliance according to claim 1, wherein said means (34) includes a control lever (36) which is mounted to pivot on the lever rod (20) and close to the free end thereof, said control lever (36) being connected to the breaking head (23) by a link member (25).

9. The manual tile cutting appliance according to claim 1, wherein said breaking head (23) is mounted to pivot about a shaft on the carriage (4), said pivoting being between said idle position and said working position; wherein said control means (34) including a control lever (36) which is mounted so as to pivot on the lever rod (20) and close to the free end thereof, said sleeve (26) being connected to the breaking head (23) by a connecting link (25) so that, when the sleeve (26) slides on the lever (20), said breaking head (23) passes between the idle position and the working position.

10. The manual tile cutting appliance according to claim 9, further comprising a return means (27) which biases the breaking head (23) into its idle position.

11. A manual tile cutting appliance comprising a base (1), a carriage (4) mounted to slide above said base (1), said carriage (4) comprising a cutting wheel (19) and a breaking head (23), means (8, 9) on said base for receiving a tile which is to be cut, control means (34) for moving said breaking head (23) between a retracted idle position to enable the cutting wheel to come into contact with and score the tile on said base (1) and a working position in which only the breaking head comes into contact with the tile, means (20) on said carriage (4) for exerting a bearing force on the wheel (19) when it is in contact with the tile and a bearing force on said breaking head (23) when in its working position, the control means (34) and the breaking head (23) being close to the free end of the said means (20) for exerting said bearing force, means for enabling said breaking head (23) to pivot between said idle position and said working position, and means (25) for connecting the control means (34) to the said breaking head (23) in order to control the pivoting of the said breaking head (23), said control means comprising a movable sleeve (26) slidably mounted on said means (20) for exerting said bearing force, said connecting means (25) being connected to maneuver control means responsible to movement of said sleeve.

* * * * *